US007093831B2

(12) United States Patent
Biegelsen et al.

(10) Patent No.: US 7,093,831 B2
(45) Date of Patent: Aug. 22, 2006

(54) MEDIA PATH MODULES

(75) Inventors: David K. Biegelsen, Portola Valley, CA (US); Lars-Erik Swartz, Sunnyvale, CA (US); Markus P. J. Fromherz, Palo Alto, CA (US); Mark H. Yim, Palo Alto, CA (US)

(73) Assignee: Palo Alto Research Center Inc., Palo Alto, CA (US)

( * ) Notice: Subject to any disclaimer, the term of this patent is extended or adjusted under 35 U.S.C. 154(b) by 553 days.

(21) Appl. No.: 10/357,687

(22) Filed: Feb. 4, 2003

(65) Prior Publication Data

US 2004/0150158 A1 Aug. 5, 2004

(51) Int. Cl.
*B65H 29/00* (2006.01)
*B65H 39/10* (2006.01)

(52) U.S. Cl. ..... 271/184; 271/185; 271/297; 271/303; 209/657

(58) Field of Classification Search ..... 271/297, 271/303, 184, 185; 209/657
See application file for complete search history.

(56) References Cited

U.S. PATENT DOCUMENTS

| | | | | | |
|---|---|---|---|---|---|
| 4,579,446 | A | | 4/1986 | Fujino et al. | 355/24 |
| 4,871,163 | A | * | 10/1989 | Landa et al. | 271/225 |
| 4,925,178 | A | * | 5/1990 | Clabbers et al. | 271/186 |
| 4,927,031 | A | * | 5/1990 | Martin | 209/657 |
| 5,303,017 | A | * | 4/1994 | Smith | 399/403 |
| 5,467,975 | A | | 11/1995 | Hadimioglu et al. | 371/267 |
| 5,868,387 | A | * | 2/1999 | Kida et al. | 271/304 |
| 6,059,284 | A | | 5/2000 | Wolf et al. | 271/227 |
| 6,550,762 | B1 | | 4/2003 | Stoll | 271/186 |
| 6,612,566 | B1 | | 9/2003 | Stoll | 271/186 |

* cited by examiner

*Primary Examiner*—Donald P. Walsh
*Assistant Examiner*—Kenneth W Bower
(74) *Attorney, Agent, or Firm*—Linda M. Ross

(57) ABSTRACT

A media transport array for forming sequential media streams feeding a media processing system in which serial flows, parallel flows, or both are desired are structured from standard, batch fabricatable media path modules. Each media path module includes a frame unit, intermodule latching means, media control electronics, and media state sensing electronics. Within each media path module, at least one media transport nip receives media and passes it to an independently actuated media director. Media guides support media as it moves into and out of the media director.

31 Claims, 8 Drawing Sheets

MEDIA PATH MODULES

CROSS REFERENCE TO RELATED APPLICATIONS

The following copending applications, U.S. application Ser. No. 10/357,761 filed Feb. 4, 2003, titled "Frameless Media Path Modules", is assigned to the same assignee of the present application. The entire disclosure of this copending application is totally incorporated herein by reference in its entirety.

INCORPORATION BY REFERENCE

The following U.S. patents are fully incorporated herein by reference: U.S. Pat. No. 5,467,975 to Hadimioglu et al. ("Apparatus and Method for Moving a Substrate"); and U.S. Pat. No. 6,059,284 to Wolf et al. ("Process, Lateral and Skew Sheet Positioning Apparatus and Method").

BACKGROUND OF THE INVENTION

This invention relates generally to media transport systems, and more particularly to sheet direction modules within such a transport system.

Paper transport systems within printing systems are generally constructed from custom designed units, usually consisting of heavy frames supporting pinch rollers driven by one or a few motors. One such system is shown in U.S. Pat. No. 6,322,069 to Krucinski et al., which utilizes a plurality of copy sheet: drives, pinch rollers, and belts to transport paper through the printer system. Another approach is taught by U.S. Pat. No. 5,303,017 to Smith, which is directed to a system for avoiding inter-set printing delays with on-line job set compiling or finishing. Smith accomplishes this through the use of sheet feeders and diverter chutes with reversible sheet feeders, also utilizing pinch rollers driven by motors. However, because prior art transport systems are custom designed to meet the differing needs of specific printing systems, field reconfigurability and programmable reconfigurability are not possible.

It is an object of this invention to provide standard, mass produced, batch fabricatable modules consisting of standard subunits, which can be linked physically, electrically and electronically, from which any path for transporting flexible media could be constructed.

SUMMARY OF THE INVENTION

Briefly stated, and in accordance with one aspect of the present invention, there is provided a media transport array for forming sequential media streams feeding a media processing system in which serial flows, parallel flows, or both are desired. The media transport array is structured from standard, batch fabricatable media path modules. Each media path module includes a frame unit, intermodule latching means, media control electronics, and media state sensing electronics. Within each media path module, at least one media transport nip receives media and passes it to an independently actuated media director. Media guides support media as it moves into and out of the media director.

BRIEF DESCRIPTION OF THE DRAWINGS

The foregoing and other features of the instant invention will be apparent and easily understood from a further reading of the specification, claims and by reference to the accompanying drawings in which:

DETAILED DESCRIPTION OF THE INVENTION

Although custom designed media transport systems are utilized extensively in industry, standard media path modules from which any media path could be constructed would enable shorter time-to-market, lower cost through economies of scale, high part reusability, field reconfigurability, and programmable reconfigurability. The media path modules disclosed herein are exemplary modules, themselves incorporating standard subunits, which can be linked physically, electrically and electronically to provide these benefits. The media path modules consist of a linkable frame, motor driven drive nip units, media convergence guide units, switchable director units, media edge and/or relative motion detection units, and power/computation/communication units. The modules link mechanically to form an integrated system which is physically strong and electrically bussed.

Figure 1:
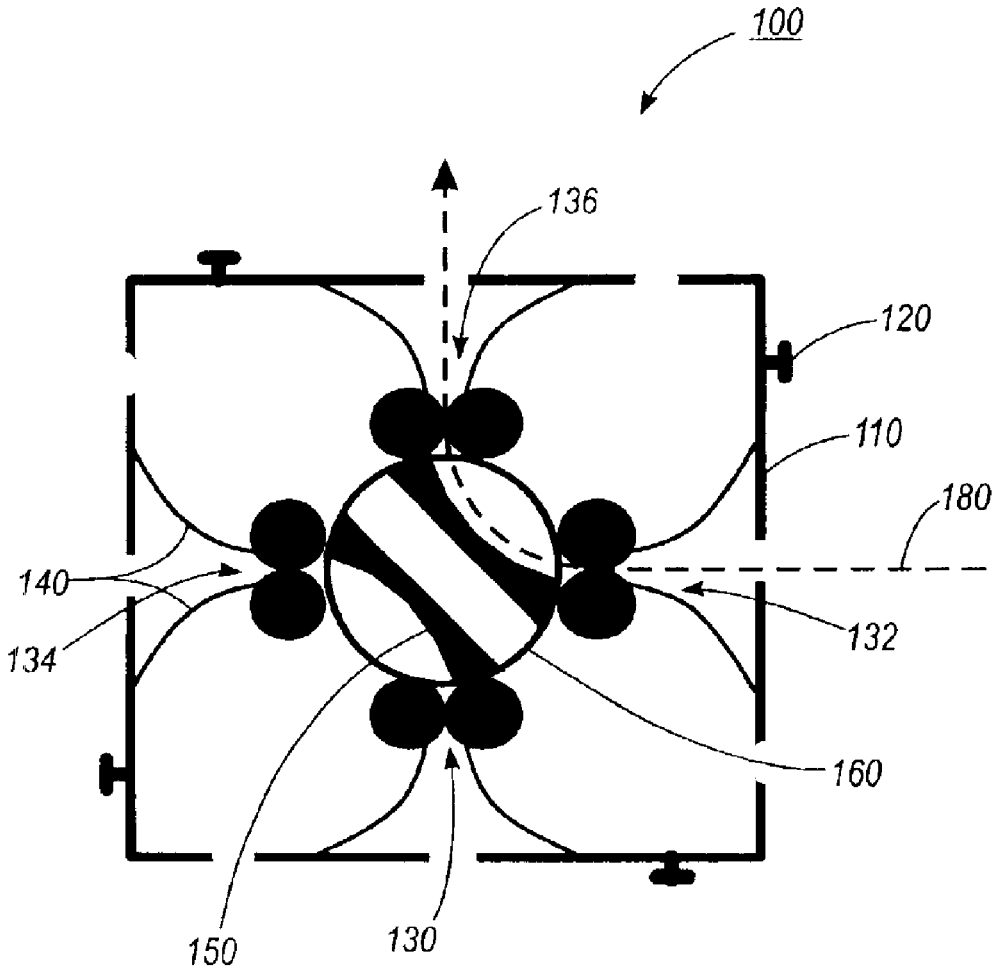
FIG. 1 illustrates a media director system module according to one embodiment of the subject invention positioned to guide media through a ninety degree turn.

FIG. 1 illustrates a side view of an exemplary embodiment of the media path modules for linearly translating media or turning media. At any instant, such modules can be used to split media streams, merge media streams or pass media along, forward or backward, in one of two orthogonal directions. The modules 100 consist of standard frame 110 with interlocking mechanisms 120 and media state sensors, such as, for example, edge detectors or relative motion detectors (not shown). Interlocking mechanisms 120 may be selected from many alternative means known to the art. Four driven transport nips 130, 132, 134, and 136 and media inlet guides 140 move media into and out from rotary media director 160. Illustrated in this embodiment are cylindrical nips, which are pinch rollers which contact the media from both sides along a line. One of the cylinders is driven rotationally about its axis and the other is an idler, which supports or provides the normal pinching force. It should be noted that other actuation means to provide tangential media forces can be used instead. An example of one such alternate means of actuation is a spherical nip actuator, which contacts the media in only a small area and is in principle capable of driving the media tangentially in an arbitrary direction, as is described in U.S. Pat. No. 6,059,284 to Wolf et al. ("Process, Lateral and Skew Sheet Positioning Apparatus and Method") incorporated herein by reference in its entirety. Another example of an alternate means of actuation is a piezoelectrically driven brush or brushes to move the media in a desired direction, as taught by U.S. Pat. No. 5,467,975 to Hadimioglu et al. ("Apparatus and Method for Moving a Substrate") incorporated herein by reference in its entirety.

Rotary media director 160 consists of a rotary housing holding in-line and deflector units 150. Cylindrical nips 130, 132, 134, and 136 can be driven using separate motors (not shown), or can be chain driven by a single motor (e.g. for a module in which media only enter from a fixed side). All drive and control electronics as well as communication bus drivers are mounted within the frame. All intermodule electrical signals (power and communication) are passed through by connectors, which mate as part of the module joining operation. In this figure, rotary media director 160 is positioned to guide media 180 into a cylindrical nip 132 on the right side of module 100 and out through a cylindrical nip 136 at the lop side of module 100 in a ninety degree path, guided by deflector unit 150. Of course by reversing the motor rotation, media transport direction is reversed. Frame units 110 and rotary media director 160 may be constructed from various known plastics and/or metals.

Figure 2:
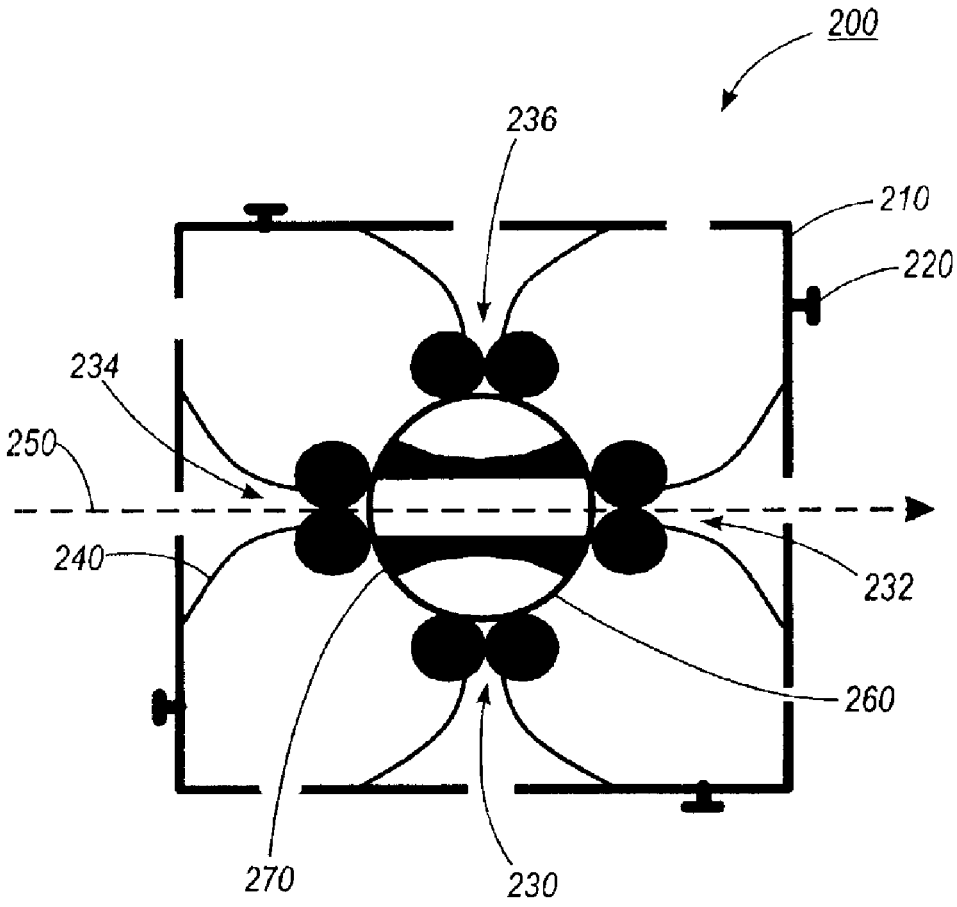
FIG. 2 illustrates the media director system module according to the embodiment of FIG. 1, positioned to guide media horizontally.

FIG. 2 illustrates the module 200 having standard frame 210 with interlocking mechanisms 220 and media state sensors, such as, for example, edge detectors or relative motion detectors (not shown). Interlocking mechanisms 220 may be selected from many alternative means known to the art. Four driven cylindrical nips 230, 232, 234, and 236 and media inlet guides 240 move media into and out from rotary media director 260. Frame units 210 and rotary media director 260 may be constructed from various known plastics and/or metals. Media director 260 consists of a rotary housing holding in-line and deflector units 270. Here rotary media director 260 is positioned to guide media 250 into cylindrical nip 234 on the left side of module 200 and out through opposing cylindrical nip 232 on the right side of module 22 along a horizontal path. Of course by reversing the motor rotation media transport direction is reversed. Cylindrical nips 230, 232, 234, and 236 can be driven using separate motors (not shown), or can be chain driven by a single motor. All drive and control electronics as well as communication bus drivers are mounted within the frame. All intermodule electrical signals (power and communication) are passed through by connectors which mate as part of the module joining operation.

Figure 3:
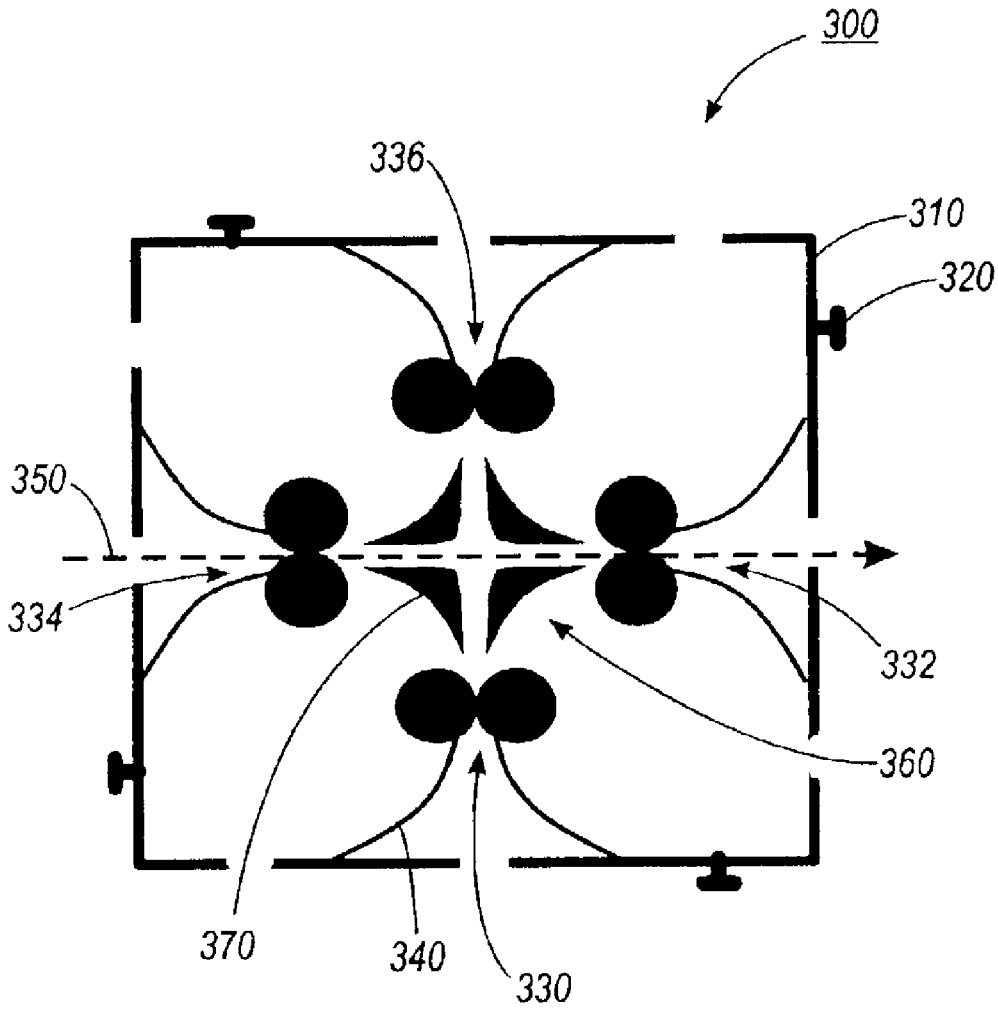
FIG. 3 illustrates a media director system module according to another embodiment of the subject invention positioned to guide media horizontally.

Turning now to FIG. 3, there is illustrated another exemplary embodiment of media path module 300. Module 300 includes frame 310 with interlocking mechanisms 320 and media state sensors, such as, for example, edge detectors or relative motion detectors (not shown). Interlocking mechanisms 320 may be selected from many alternative means known to the art. Four driven cylindrical nips 330, 332, 334, and 336 and media inlet guides 340 move media into and out from media director 360. Frame units 310 and media director 360 may be constructed from various known plastics and/or metals. Media director 360 consists of laterally shifted deflector vanes with pass-through centers 370. Here media director 360 is positioned in a first orientation to guide media 350 into cylindrical nip 334 on the left side of module 300 in a horizontal path through opposing cylindrical nip 332 on the right side of module 300. Of course by reversing the motor rotation media transport direction is reversed. Media director 360 is translated at 45 degrees to the horizontal and vertical axes in milliseconds by one of various possible drive mechanisms (not shown), such as, for example, linear motors with simple hinged connections to the media director or a rack and pinion coupling. Alternatively, multiposition solenoids can be used, as well as other drive mechanisms known in the art. Detents may be utilized to achieve director positioning, or an LED/photodiode pair could be used to add precision to director positioning. Cylindrical nips 330, 332, 334, and 336 can be driven using separate motors (not shown), or can be chain driven by a single motor (e.g. for a module in which media only enter from a fixed side). All drive and control electronics as well as communication bus drivers are mounted within the frame. All intermodule electrical signals (power and communication) are passed through by connectors, which mate as part of the module joining operation.

Figure 4:
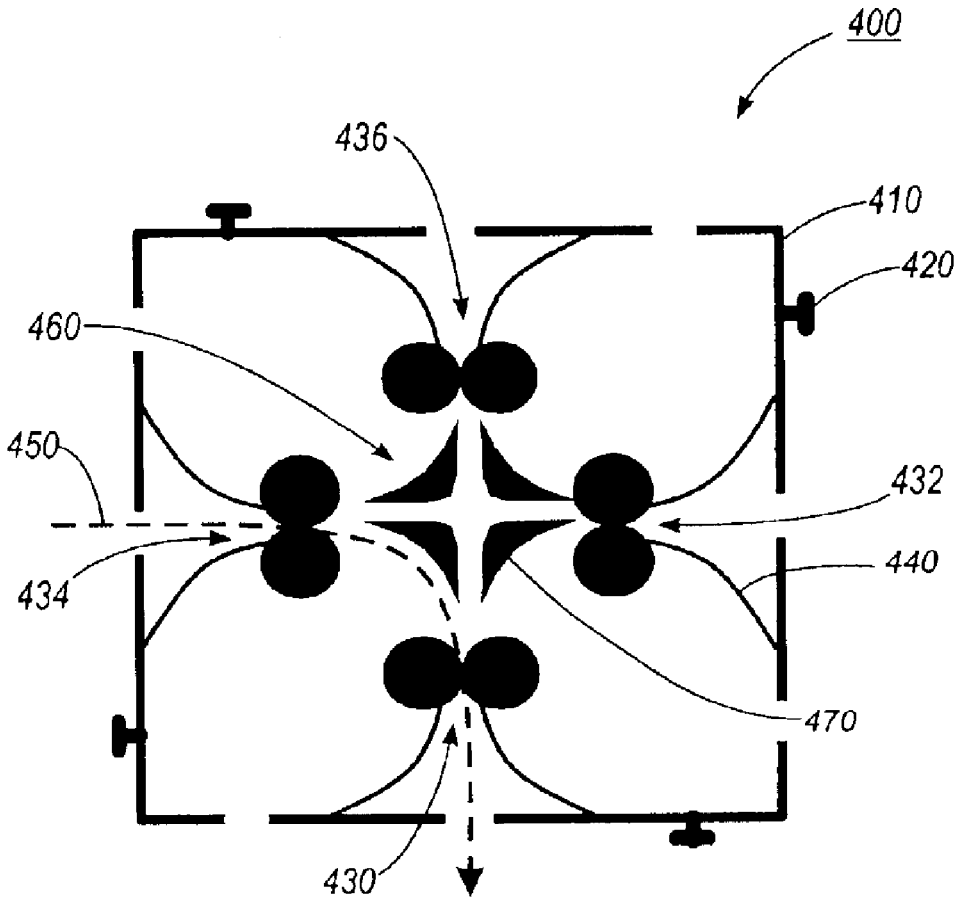
FIG. 4 illustrates a media director system module according to the embodiment of FIG. 3, positioned to guide media through a ninety degree turn.

Referring now to FIG. 4, there is illustrated another exemplary embodiment of media path module 400. Module 400 includes frame 410 with interlocking mechanisms 420 and media state sensors, such as, for example, edge detectors or relative motion detectors (not shown). Interlocking mechanisms 420 may be selected from many alternative means known to the art. Four driven cylindrical nips 430, 432, 434, and 436 and media inlet guides 440 move media into and out from media director 460. Frame units 410 and media director 460 may be constructed from various known plastics and/or metals. Media director 460 consists of translated deflector vanes with pass-through centers 470. Here media director 460 is translated up and to the right to guide media 450 into cylindrical nip 434 on the left side of module 400 and out through cylindrical nip 430 at the bottom of module 400 in a ninety-degree path. Of course by reversing the motor rotation media transport direction is reversed. Media director 460 is translated in milliseconds by one of various possible drive mechanisms (not shown), such as, for example, linear motors with simple hinged connections to the media director or a rack and pinion coupling. Alternatively, multiposition solenoids can be used, as well as other drive mechanisms known in the art. Detents may be utilized to achieve director positioning, or an LED/photodiode pair could be used to add precision to director positioning. All drive and control electronics as well as communication bus drivers are mounted within the frame. All intermodule electrical signals (power and communication) are passed through by connectors, which mate as part of the module joining operation.

Figure 5:
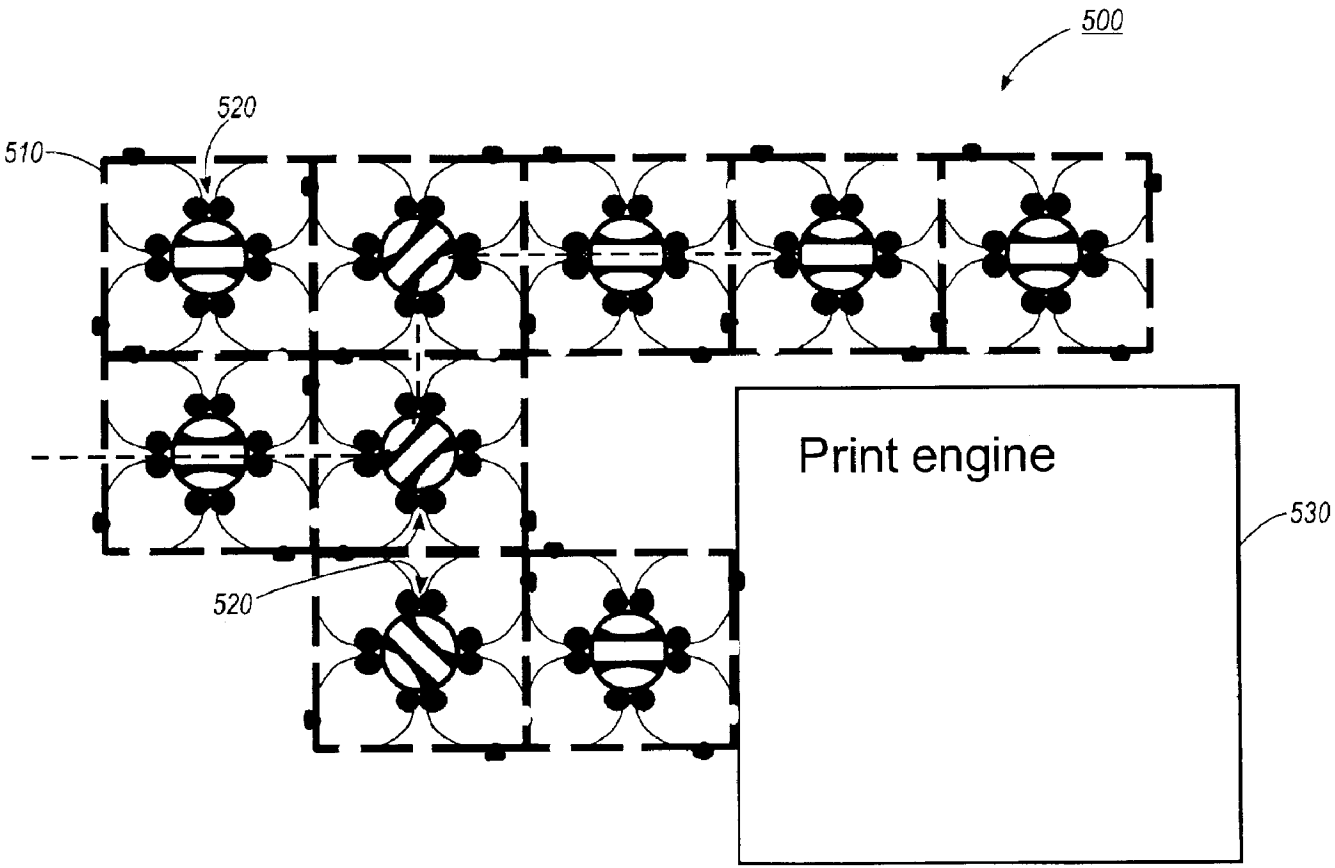
FIG. 5 illustrates an array of media director modules in the embodiment of FIG. 1 configured as a print engine media path.

Turning now to FIG. 5, an array of modules 500 illustrates an example of a reconfigurable media path configured around units such as a print engine 530 (xerographic, ink jet, or other), finishers, input sources, etc. In array 500 media paths can be retrograde as well as forward transporting and parallel flows can be enabled. The size of media modules 510 is determined by several aspects of the media to be transported. The spacing between nips 520 must be less than the shortest media length in the process direction. Nips 520 are beneficially, but not necessarily, placed within a module such that the spacing between nips 520 is uniform throughout the media path after module connection. Another constraint is directed to the radius of curvature in turns, which cannot be too small to accommodate the stiffest media that may move through the array. A typical radius in xerographic printers is approximately five centimeters. With the constraints typical of current xerographic use, modules as shown here and used in such an application would be approximately twenty centimeters on a side and have a five-centimeter radius of curvature in turning operations.

Figure 6:
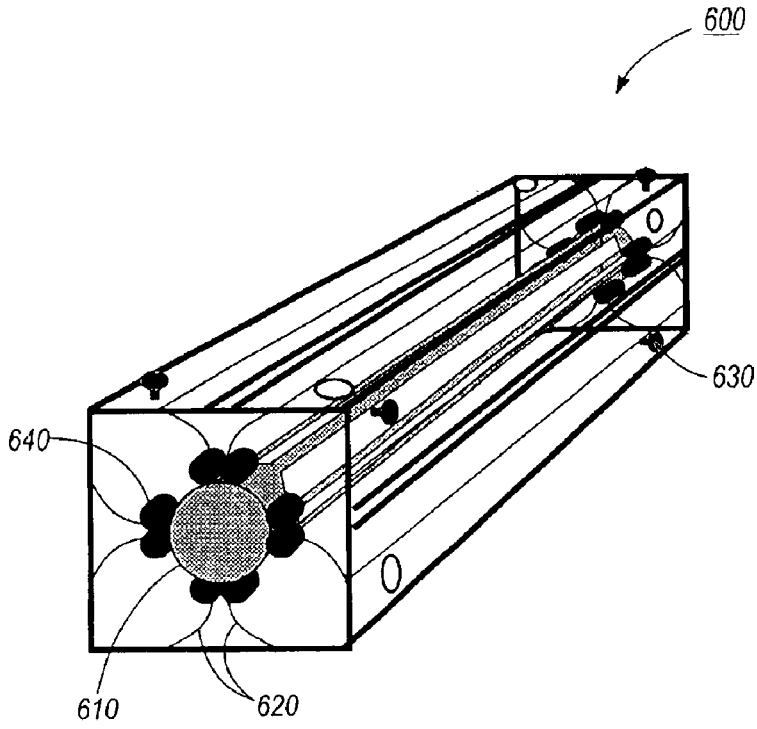
FIG. 6 is a perspective view of the media director system module according to the embodiment of FIG. 1.

The media path module embodiments of FIGS. 1 and 2 are shown in a perspective view in FIG. 6. In this embodiment cylindrical nip drives 640 continue the length of the module, although their individual parts are indicated only at the end of module 600 for the purposes of clarity. As described in more detail hereinabove, media is received from media inlet guides 620, proceeds through cylindrical nip 640, and into rotary media director 610, which directs media either forward or backward, in one of two directions. Intermodule connectors 630 provide the capability for connecting individual modules and also for intermodule connections for communication and control electronics.

Figure 7:
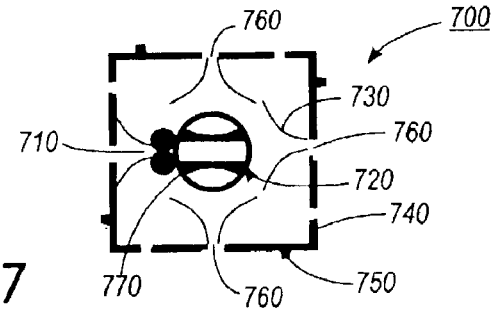
FIG. 7 illustrates a media director system module according to another embodiment of the subject invention.

Another exemplary embodiment of the media path modules for linearly translating media or turning media is illustrated in FIG. 7. In this embodiment, module 700 consists of standard frame 740 with interlocking mechanisms 750 and media state sensors, such as, for example, edge detectors or relative motion detectors (not shown). Interlocking mechanisms 750 may be selected from many alternative means known to the art. A single driven transport nip 710 and media inlet/outlet guides 730 move media into rotary media director 720. At any instant, such modules, with a single allowed input, can be used to direct media output in any of three directions 760. Illustrated in this embodiment are cylindrical nips, described in more detail hereinabove. However, it should be noted that other actuation means to provide tangential media forces can be used instead. Examples of alternate means of actuation include a spherical nip actuator and a piezo pusher means, as described hereinabove with reference to the embodiment illustrated in FIG. 1.

Rotary media director 720 consists of a rotary housing holding in-line and deflector units 770. Cylindrical nips 710 can be driven using separate motors (not shown), or can be chain driven by a single motor (e.g. for a module in which media only enter from a fixed side). All drive and control electronics as well as communication bus drivers are mounted within the frame. All intermodule electrical signals (power and communication) are passed through by connectors, which mate as part of the module joining operation. In this figure, rotary media director 720 is positioned to guide media (not shown) into a cylindrical nip 710 on the left side of module 700 and out through media inlet/outlet guides 730 at the right side of module 700 in a flow-through path, guided by deflector unit 720. Frame units 740 and rotary media director 720 may be constructed from various known plastics and/or metals. Although this embodiment has been described with the media director in the form of a rotary housing, it will be appreciated that media director 720 could also take the form of translated deflector vanes with pass-through centers as described with reference to FIG. 3.

Figure 8:
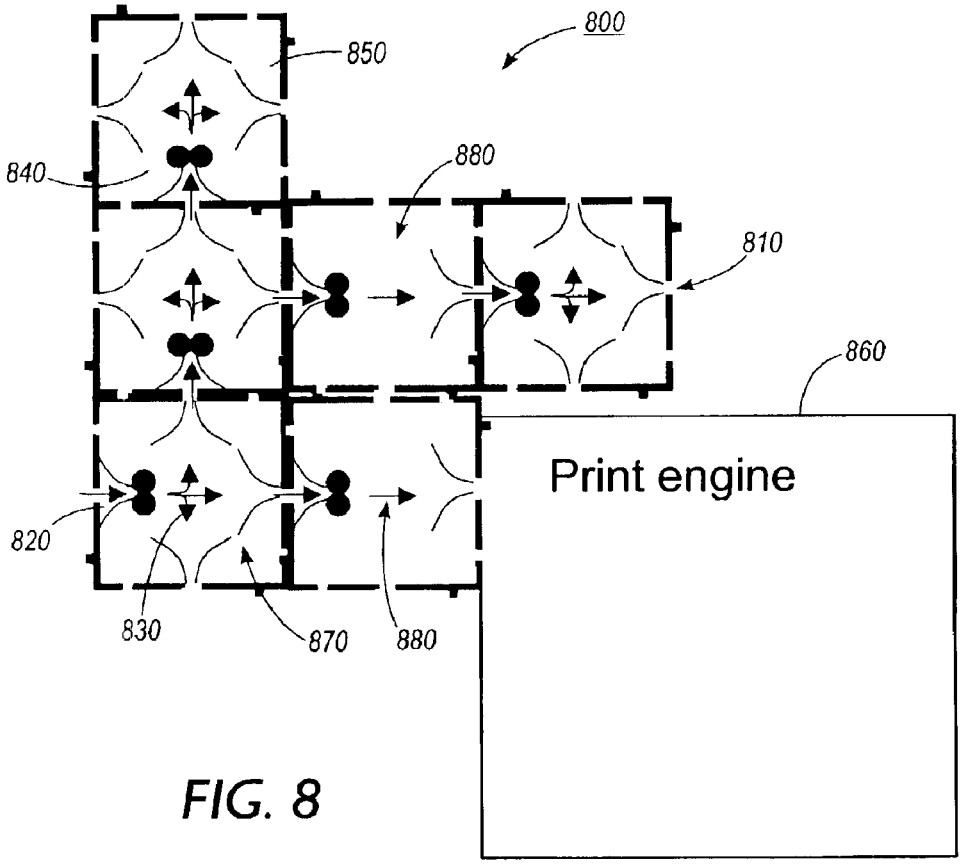
FIG. 8 illustrates an array of media director modules in the embodiment of FIG. 7 configured as a print engine media path.

FIG. 8 illustrates an example embodiment of a media path utilizing the single inlet/multiple outlet media path module embodiment described with respect to FIG. 7. In this embodiment, a reconfigurable media path is structured from a plurality of single inlet/multiple outlet media path modules 850 around units such as a print engine 860 (xerographic, ink jet, or other), or finishers, input sources, etc. In array 800 media paths are forward transporting and parallel flows can be enabled, as shown by media paths 810 and 870. Media flow may also be diverted to various alternate destinations, as illustrated by the exit directions of media paths 810 and 840. In this embodiment the function of the media director is shown schematically, for clarity; it will be appreciated that the media director could take the form of any of the media director embodiments described herein.

The size of media modules 850 is determined by several aspects of the media to be transported. The spacing between nips 820 must be less than the shortest media length in the process direction. Nips 820 are placed within a module such that the spacing between nips 820 is beneficially uniform throughout the media path after module connection. Another constraint is directed to the radius of curvature in turns, which cannot be too small to accommodate the stiffest media that may move through the array. A typical radius in xerographic printers is approximately five centimeters. With the constraints typical of current xerographic use, modules as shown here and used in such an application would be approximately twenty centimeters on a side and have a five centimeter radius of curvature in turning operations. In those cases in which pass-through flow only is desired, extraneous module elements may be removed from the individual modules, such as in modules 880, in which the media director and extraneous media guides have been removed.

Figure 9:
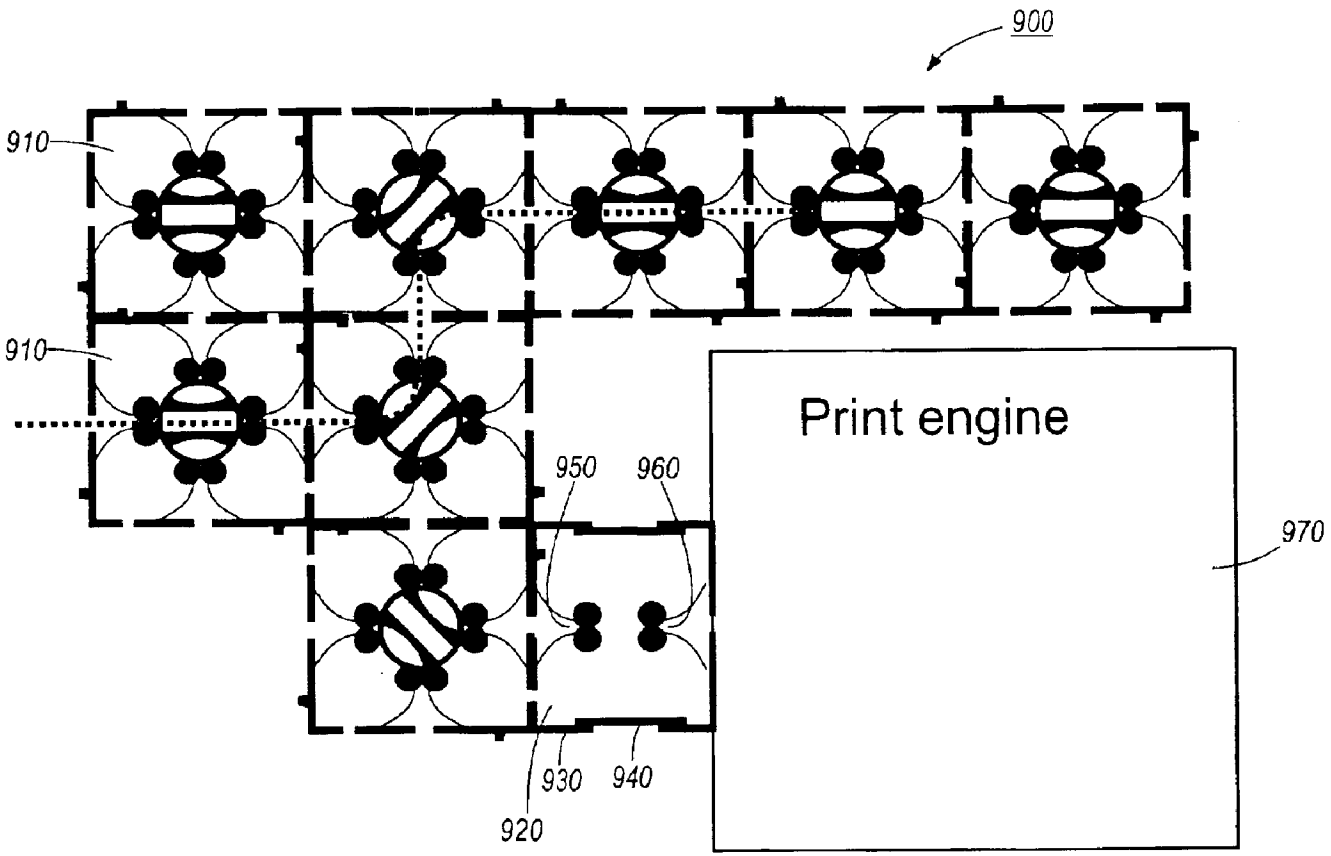
FIG. 9 illustrates an array of media director modules including an embodiment of an extensible transport module according to the subject invention.

In the embodiments described hereinabove, the media path modules are essentially uniform along their length with the motor drives mounted at the two ends, Optionally, in those systems where certain degrees of freedom are fixed (not programmably reconfigurable) the media director may be replaced with a fixed guide unit and related motor drives may be omitted or removed. Furthermore, extensible straight transport modules (having no director) shorter than the active modules can be interposed to allow for arbitrary length runs between connected engines (such as print engines or finishers or paper sources, etc.) to be achieved. Turning now to FIG. 9, media path modules are configured in an example system 900 in which and example embodiment of an extensible straight transport module 920 is included to provide a shortened connection run to print engine 970. Extensible straight transport module 920 includes frame 930 and frame extensions 940 in the form of parallel plates upon which frame 930 may be telescoped. Module 920 also includes in this example embodiment two transport nips 950 and 960, but it is understood that such a module would operate beneficially with one nip only.

While the present invention has been illustrated and described with reference to specific embodiments, further modification and improvements will occur to those skilled in the art. For example, media path modules can use separately driven nips and the nips can have independently driven segments in the cross-process direction as well, which would permit de-skewing and other operations requiring more than one degree of freedom. Furthermore, the directors can be driven in time-dependent motions. For example, the translational director can be over-retracted to facilitate entry of the sheet leading edge into the curved surface of the director, and then returned to the sheet turning position. Additionally the in-line/deflector units and the deflector vanes of the example embodiments of the media directors described herein may take various alternate forms, as will be appreciated by one knowledgeable in the art. It is to be understood, therefore, that this invention is not limited to the particular forms illustrated and that it is intended in the appended claims to embrace all alternatives, modifications, and variations which do not depart from the spirit and scope of this invention.

What is claimed:

1. For a media processing system feeding media streams through a media path structured for serial or parallel flows, a media transport array comprising:

not less than two media path modules, wherein each of said media path modules comprises:

a frame unit;

an intermodule latching means;

not less than one media transport nip;

actuation means;

a media director;

media control electronics; and media state sensing electronics.

2. The media transport array according to claim 1, wherein said latching means comprises at least one interlocking mechanism.

3. The media transport array according to claim 1, wherein said frame unit further comprises signal interconnect means.

4. The media transport array according to claim 3, wherein said signal interconnect means comprises signal pass through connectors which mate during a module joining operation.

5. The media transport array according to claim 1, wherein said not less than one media transport nip comprises not less than one cylindrical nip.

6. The media transport array according to claim 1, wherein said not less than one transport nip comprises not less than one spherical nip.

7. The media transport array according to claim 1, wherein said not less than one media transport nip comprises not less than one piezoelectrically driven brush.

8. The media transport array according to claim 1, further comprising a plurality of media guides.

9. The media transport array according to claim 8, wherein said plurality of media guides comprises not less than two media inlet guides for each said media transport nip.

10. The media transport array according to claim 1, wherein said actuation means comprises not less than one motor drive unit.

11. The media transport array according to claim 1, wherein said actuation means comprises not less than one motor drive unit for each of said media transport nips.

12. The media transport array according to claim 1, wherein said media director further comprises a rotary housing having in-line and deflector means for directing media.

13. The media transport array according to claim l, wherein said media director further comprises translational deflector vanes with pass through centers for directing media.

14. The media transport array according to claim 13, wherein said translational deflector vanes may be over-retracted.

15. The media transport array according to claim 1, wherein said media director further comprises media director actuation means.

16. The media transport array according to claim 15, wherein said media director actuation means comprises a linear motor.

17. The media transport array according to claim 15, wherein said media director actuation means comprises a rotary motor.

18. The media transport array according to claim 15, wherein said media director actuation means comprises a multi-position solenoid.

19. The media transport array according to claim 1, wherein said media director further comprises media director positioning means.

20. The media transport array according to claim 19, wherein said media director positioning means comprises detents.

21. The media transport array according to claim 19, wherein said media director positioning means comprises a photodiode pair.

22. The media transport array according to claim 1, wherein said media control electronics comprise media movement electronics.

23. The media transport array according to claim 1, wherein said media control electronics comprise computation electronics.

24. The media transport array according to claim 1, wherein said media control electronics comprise communication electronics.

25. The media transport array according to claim 1, wherein said media director comprises fixed media guide means.

26. The media transport array according to claim 1, wherein said media transport nips are spaced apart uniformly throughout the length of the media path.

27. The media transport array according to claim 1, wherein the spacing between any two of said media transport nips is less than the shortest media length in the process direction.

28. The media transport array according to claim 1, wherein each of said media transport nips within said media path module may be separately actuated.

29. The media transport array according to claim 1, further comprising not less than one extensible transport module having no media director.

30. The media transport array according to claim 29, wherein said not less than one extensible transport module further comprises not less than one transport nip.

31. The media transport array according to claim 29, wherein said not less than one extensible transport module further comprises a plurality of media guides.

* * * * *

UNITED STATES PATENT AND TRADEMARK OFFICE

CERTIFICATE OF CORRECTION

PATENT NO. : 7,093,831 B2
APPLICATION NO. : 10/357687
DATED : August 22, 2006
INVENTOR(S) : Biegelsen et al.

It is certified that error appears in the above-identified patent and that said Letters Patent is hereby corrected as shown below:

Please insert item, [74] of Attorney, Agent, or Firm —Linda M. Robb.

Signed and Sealed this

Seventh Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 7,093,831 B2
APPLICATION NO. : 10/357687
DATED : August 22, 2006
INVENTOR(S) : David K. Biegelsen et al.

It is certified that error appears in the above-identified patent and that said Letters Patent is hereby corrected as shown below:

Title page item 73 should read

(73) Assignee: Palo Alto Research Center Incorporated, Palo Alto, CA (US)

Signed and Sealed this

Second Day of September, 2008

JON W. DUDAS
*Director of the United States Patent and Trademark Office*